US006223479B1

(12) United States Patent
Stöckli

(10) Patent No.: US 6,223,479 B1
(45) Date of Patent: May 1, 2001

(54) EXTENDABLE AND RETRACTABLE BUILDING AND MECHANISM FOR EXTENDING AND RETRACTING

(76) Inventor: Jakob Stöckli, Horizons NR 4, Frigate Bay, St. Kitts W.I. (KN)

( * ) Notice: Subject to any disclaimer, the term of this patent is extended or adjusted under 35 U.S.C. 154(b) by 0 days.

(21) Appl. No.: 09/266,428

(22) Filed: Mar. 11, 1999

Related U.S. Application Data

(60) Provisional application No. 60/078,003, filed on Mar. 13, 1998.

(51) Int. Cl.[7] ..... E04B 1/343
(52) U.S. Cl. ..... 52/68; 52/69; 52/126.1
(58) Field of Search ..... 52/64, 66, 68–71, 52/79.1, 79.5, 79.6, 79.7, 126.1, 127.2

(56) References Cited

U.S. PATENT DOCUMENTS

| | | | |
|---|---|---|---|
| 2,860,384 | 11/1958 | Wait et al. . | |
| 3,792,557 | 2/1974 | Pitts . | |
| 4,534,141 | 8/1985 | Fagnoni . | |
| 4,603,518 | 8/1986 | Fennes . | |
| 4,741,133 | 5/1988 | Kutzner . | |
| 4,891,919 | 1/1990 | Palibroda . | |
| 5,237,784 | 8/1993 | Ros . | |
| 5,596,844 | 1/1997 | Kalinowski . | |
| 5,921,033 * | 7/1999 | Molina | 52/67 |

OTHER PUBLICATIONS

European Search Report Apr. 27, 2000.

* cited by examiner

*Primary Examiner*—Beth A. Stephan
(74) *Attorney, Agent, or Firm*—Baker Botts L.L.P.

(57) ABSTRACT

An extendable and retractable building includes floor and roof assemblies, each having a number of components movable between respective stowed and extended positions. A support structure may be provided to couple the floor assembly and the roof assembly. A cable coupling a component of the floor assembly and a component of the roof assembly preferably extends through at least two pullies in order to at least partially balance the weights associated with the respective components of the floor and roof assemblies. In one embodiment, the floor and roof assemblies may each include first, second, and third sections. A first cable may be coupled with support beams associated with the second floor section and a support beam connected with the third roof section. A second cable may also be provided coupled with a support beam connected with a third floor section and a support beam connected with the second roof section.

29 Claims, 9 Drawing Sheets

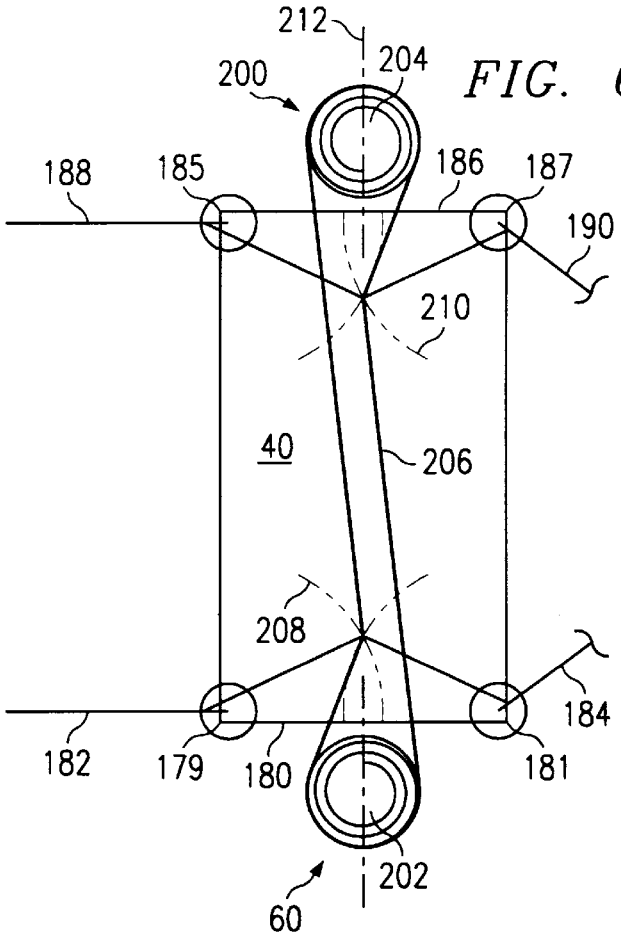
FIG. 6A
FIG. 6B
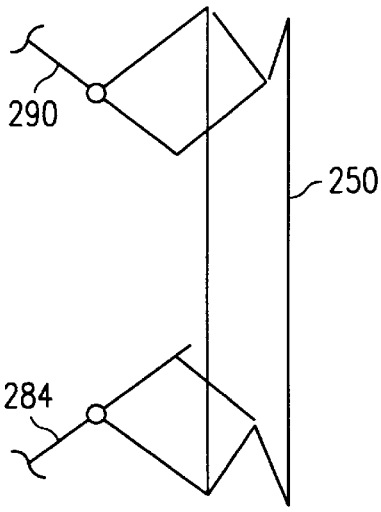
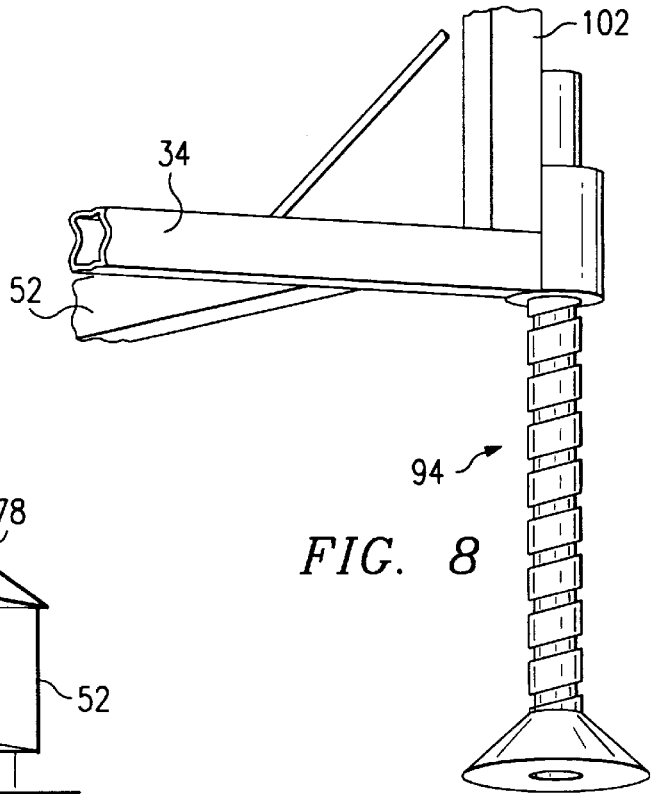
FIG. 8
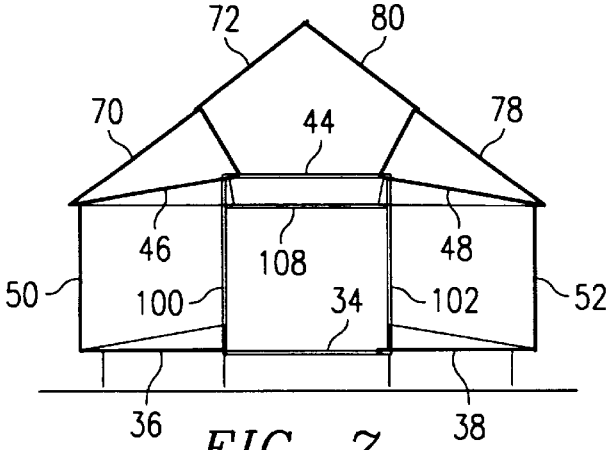
FIG. 7

EXTENDABLE AND RETRACTABLE BUILDING AND MECHANISM FOR EXTENDING AND RETRACTING

RELATED APPLICATION

This application claims the benefit of previously filed provisional patent application Ser. No. 60/078,003 filed Mar. 13, 1998 entitled "Extendable/Retractable Building and Mechanism for Extending/Retracting It."

FIELD OF THE INVENTION

The present invention relates generally to extendable and retractable structures and, more particularly, to an extendable and retractable building that reduces the amount of external force required for movement between its extended and retracted positions.

BACKGROUND OF THE INVENTION

Buildings that retract into compact units for transport and storage and extend for use are known in a large number of forms. It is likewise known to include mechanisms, both manually powered and motor-driven, to extend and retract such buildings. Examples of buildings that include automated mechanisms for extending and retracting the building are described and shown in U.S. Pat. No. 3,792,557 (Pitts, 1974) and U.S. Pat. No. 4,603,518 (Fennes, 1986). Previously known arrangements for extendable buildings and other structures generally include mechanisms for extending and retracting which require large forces for operation. Large operating forces are typically associated with buildings of large sizes and/or have heavy, strong components which must be moved between extended and retracted positions.

SUMMARY OF THE INVENTION

In accordance with the teachings of the present invention, disadvantages and problems associated with fabrication, assembly and use of extendable and retractable building and associated components have been substantially reduced or eliminated.

One embodiment of the present invention provides an extendable and retractable building or other structure in which associated components are arranged in a manner that permits the building or other structure to be retracted and extended by relatively low net forces, thus requiring little manual and/or mechanical power for operation. An extendable and retractable building or structure incorporating teachings of the present invention may be readily adaptable to many uses, to many forms of construction, and to a wide range of sizes, including very large buildings of 2000 or more square feet in area, while retaining a relatively small "footprint" in the retracted position. One aspect of the present invention is a highly automated mechanism for extending and retracting a building or other structure. Accordingly, an extendable and retractable building incorporating teachings of the present invention may be extended and/or retracted by hand or in conjunction with mechanical devices and/or power sources.

Another embodiment of the present invention includes an extendable and retractable building having floor and roof assemblies, with a number of components movable between respective stowed and extended positions. A support structure may be provided to couple the floor assembly and the roof assembly. A cable coupling a component of the floor assembly and a component of the roof assembly may extend through at least two pullies to at least partially balance the weight associated with respective components of the floor and roof assemblies. In one embodiment, the floor and roof assemblies may each include first, second, and third sections. A first cable may be coupled with support beams associated with the second floor section and a support beam connected with the third roof section. A second cable may also be provided coupled with a support beam connected with a third floor section and a support beam connected with the second roof section.

In another embodiment, the second and third floor sections may extend from the first floor section toward the first roof section and at least partially occupy a space between the first floor section and first roof section in their respective stowed positions. Similarly, the second roof section and the third roof section may extend from the first roof section toward the first floor section, at least partially occupying a space between the first floor and roof sections in their respective stowed positions. In their extended positions, the second and third floor sections may extend outwardly from the first floor section and the second and third roof sections may extend outwardly from the first roof section.

In a different embodiment, a gear assembly sized to engage a portion of the first cable is preferably provided such that rotation of the gear assembly in a direction moves an attached floor section and an attached roof section from their respective stowed to extended positions. Rotation of the gear assembly in a second opposite from the first direction preferably moves the attached floor section and attached roof section from their respective extended to stowed positions. Similarly, a second gear assembly sized to engage a portion of a second cable may be provided such that rotation of the second gear assembly in a first direction moves the attached floor section and the attached roof section from their respective stowed to extended positions. Rotation of the second gear assembly in a second direction opposite the first direction preferably moves the attached floor section and roof section from their respective extended to stowed positions. In yet another embodiment, a main gear and drive shaft assembly may be provided and coupled with the gear assemblies.

Another aspect of the present invention includes an extendable and retractable building having a number of wall assemblies at least partially disposed between a floor section and a roof section. Each wall assembly may include a number of components which move between respective stowed and extended positions. Pulley assemblies and at least one cable engaged therewith may be attached to the wall assemblies whereby movement of the cable in opposing first and second directions will move the attached wall assemblies between their respective stowed and extended positions.

Technical advantages of the present invention include the ability to move an extendable and retractable building between respective extended and stowed positions with a minimal amount of external force, thus requiring little manual and/or mechanical power for operation. Another technical advantage includes an extendable and retractable building readily adaptable to many uses, a wide range of sizes, and many forms of construction. Yet another technical advantage of the present invention is the relatively small "footprint" of the building in its stowed position, which allows movement of the building in its retracted position by a wide variety of vehicles including automobiles, trucks and trailers.

BRIEF DESCRIPTION OF THE DRAWINGS

For a more complete understanding of the present invention and its advantages thereof, reference is now made to the following brief description, taken in conjunction with the accompanying drawings and detailed description, wherein like reference numerals represent like parts, in which:

FIG. 6A is a schematic drawing in section showing a top view of an extendable and retractable building, with portions broken away;

FIG. 6B is a schematic drawing in section, with portions broken away, showing a top view of an alternative sidewall configuration:

FIG. 7 is a schematic drawing in section of a side view of an extendable and retractable building, with portions broken away, showing another component configuration;

FIG. 8 is a schematic drawing showing an isometric view with portions broken away, of the extendable and retractable building of FIG. 1, and an associated floor jack device.

DETAILED DESCRIPTION OF THE INVENTION

Preferred embodiments of the present invention and its advantages are best understood by referring now in more detail to FIGS. 1–8 of the drawings, in which like numerals refer to like parts.

Figure 1:
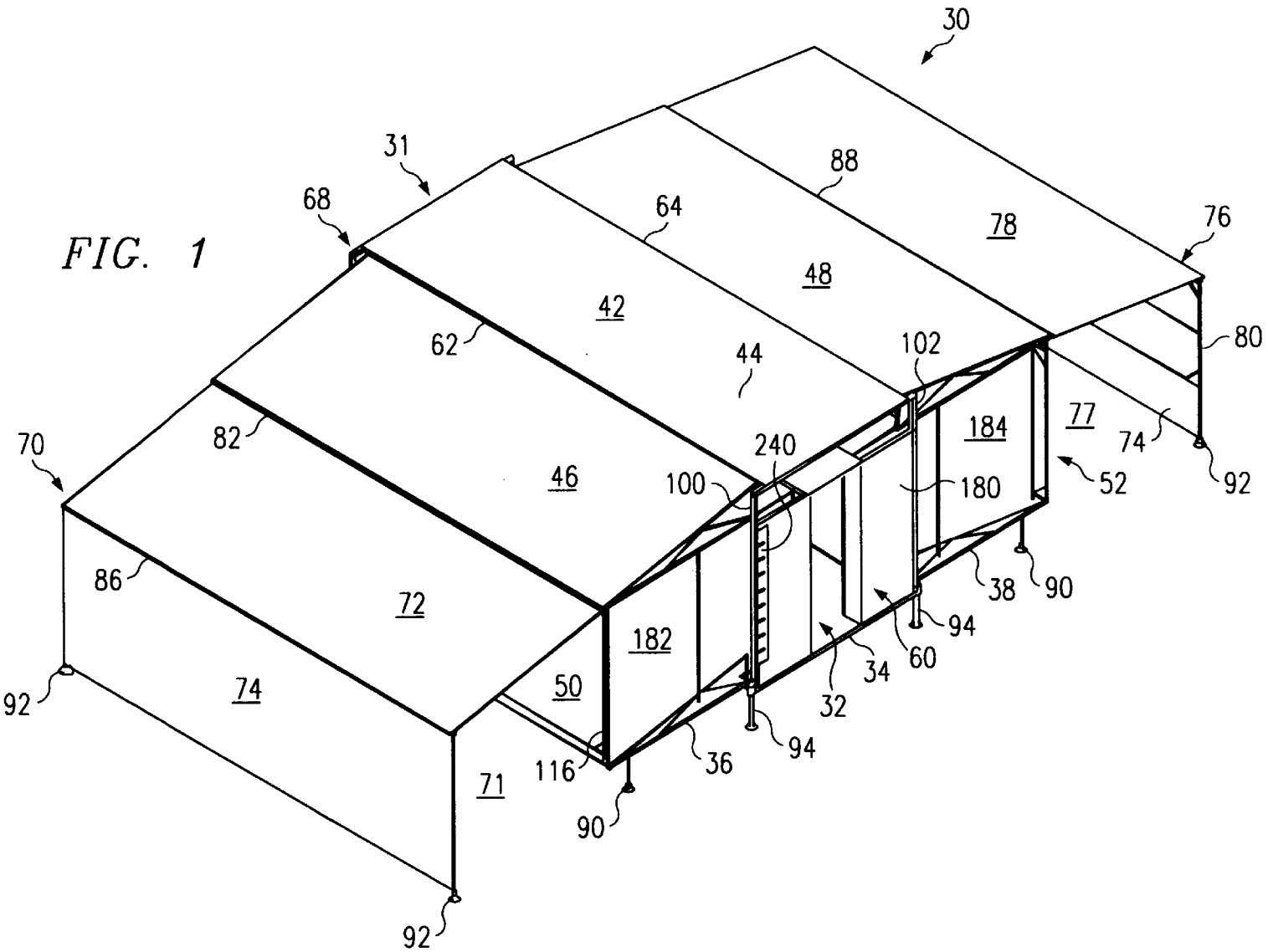
FIG. 1 is a schematic drawing showing a perspective view of an extendable and retractable building in its extended position, incorporating teachings of the present invention.

Extendable and retractable building 30, incorporating aspects of the present invention, is illustrated in FIG. 1. A plurality of components associated with building 30 may be extended and configured to form portions of a floor, roof, ceiling panel, side walls and end walls, capable of extending the footprint of building 30 more than five times its original size. In one embodiment, building 30 may be joined with additional buildings to form a larger structure. Conversely, the components may be retracted and folded to respective stowed positions forming a compact box having a relatively small footprint.

The mobility, portability and extendability of a building or other structure incorporating teachings of the present invention allows a wide range of uses. In one embodiment, building 30 may be configured to form a large luxurious motor or removable home having an interior, in excess of 1,200 square feet in its extended position. Building 30 can also be used as a park-stationed mobile home in localities where mobile homes must be vehicles and are regularly inspected outside of the park for compliance with local ordinances. In another embodiment, building 30 may be configured to form an inexpensively transportable mobile office, hotel, refugee camp, army barracks, or prefabricated, multi-room house complete with bedrooms, water tanks, showers, toilets, and many other built-in amenities. These examples are not intended to be exhaustive, as a building or structure incorporating teachings of the present invention may be used in practically any circumstance where protection from the elements is desired.

Referring to FIG. 1, building 30 comprises a basic enclosure 31, defined in part by floor assembly 32, roof assembly 42, sidewall assemblies 50 and 52 and end wall assemblies 60 and 68. A pair of garage assemblies 70 and 76 are attached to enclosure 31 and further enclose garage areas 71 and 77, adjacent to enclosure 31. Garage areas 71 and 77 may be used to store items which require protection from the elements. In another embodiment garage areas 71 and 77 may be further enclosed for use as additional living space along with basic enclosure 31. In yet another embodiment, to be discussed in more detail later, roof panel 72 and sidewall 74, associated with garage assembly 70 may be extended upward to meet roof panel 78 and sidewall 80 associated with garage assembly 76, which also extend upwardly, to form a roof canopy.

A plurality of adjustable support posts 90 may be attached to enclosure 31 to provide structural support and maintain enclosure 31 above ground level. Similarly, support posts 92 may be attached to garage assemblies 70 and 76. Floor jacks 94 may also be provided to allow enclosure 31 to be raised and lowered mechanically. Floor jacks 94 also provide the ability to raise building 30 from a delivery vehicle (not expressly shown) when building 30 is in its stowed position. Examples of such delivery vehicles include, but are not limited to, automobiles, trucks and trailers. In combination, support posts 90 and 92 and floor jacks 94 allow building 30 to be leveled with respect to the adjacent surface to correct for variations in elevation.

Figure 2A:
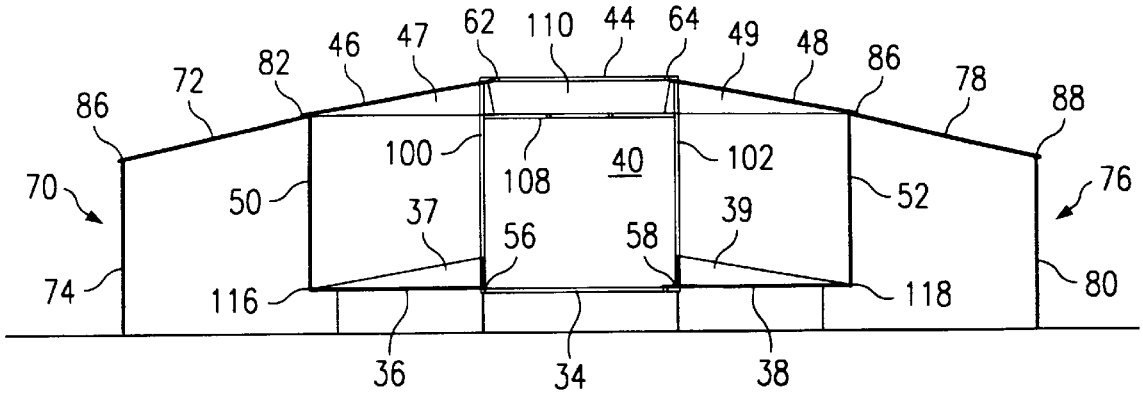
FIGS. 2A–2C are schematic drawings, with portions broken away, showing cross-sectional side views of the extendable and retractable building of FIG. 1, during movement from its extended position to its retracted position.
Figure 2B:
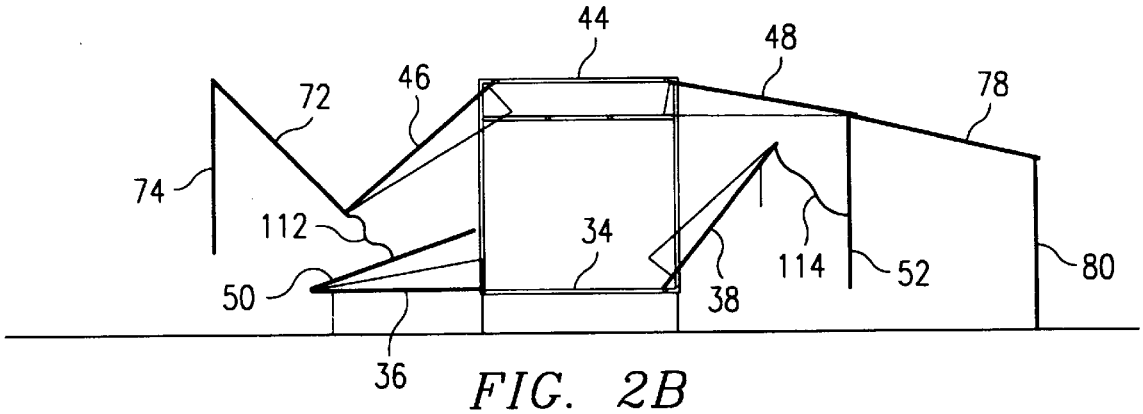
Figure 2C:
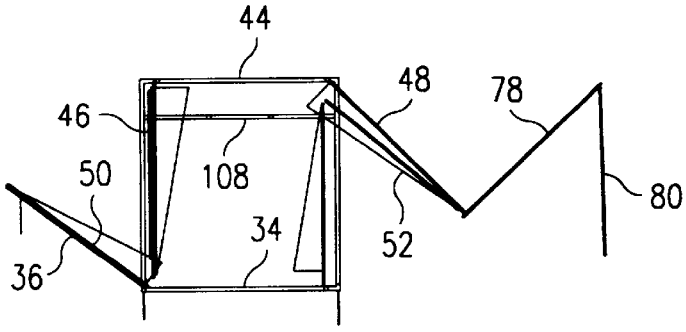
Figure 2D:
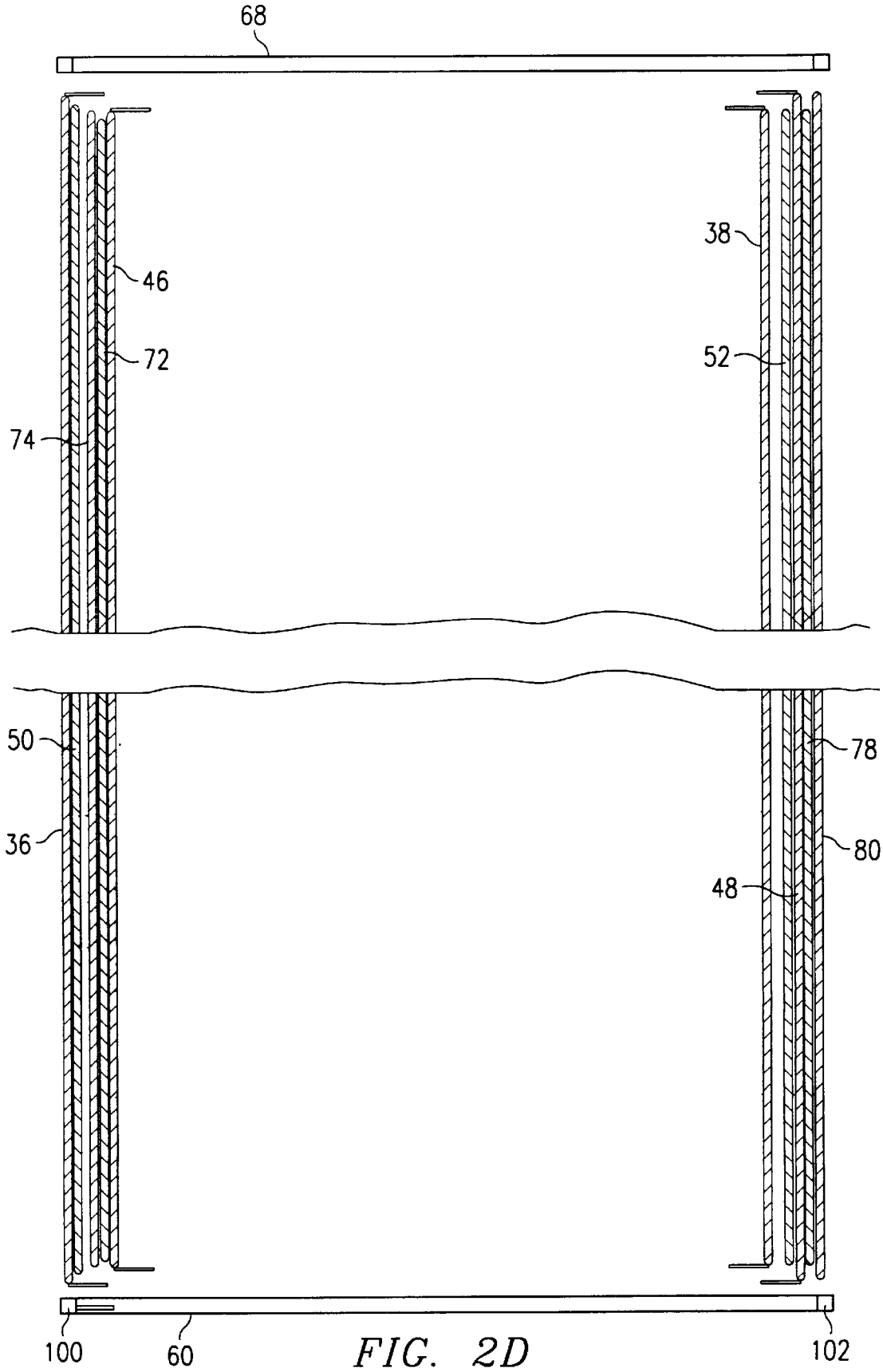
FIG. 2D is a schematic drawing, with portions broken away, showing a cross-sectional top view of the extendable and retractable building of FIG. 1, in its retracted position.

The components of building 30 and their ability to retract from their extended position shown in FIG. 2A to their stowed position shown in FIG. 2D, will be discussed in more detail with respect to FIGS. 2A–2D. In this embodiment, the extended position of building 30 may provide approximately five times the amount of floor space as the stowed position of building 30.

Floor assembly 32 may include a main or first floor section 34 with two extendable floor sections 36 and 38 extending outwardly with respect to main floor section 34. Similarly, roof assembly 42 may include a main, or first roof section 44 with extendable roof sections 46 and 48 extending outwardly therefrom. Main floor section 34 and main roof section 44 remain relatively stationary with respect to each other and cooperate to partially define storage area 40.

A pair of support beams 37 and 39 are coupled to extendable floor sections 36 and 38 to provide support and stability to their respective floor sections 36 and 38. Support beams 37 and 39 are coupled with main floor section 34 at opposing edges 56 and 58. Extendable floor section 36 and support beam 37 are coupled to main floor 34 for pivotal movement about an axis substantially coincident with edge 56 of main floor 34. In a similar manner, extendable floor section 38 and support beam 39 are coupled to main floor section 34 to allow pivotal movement about an axis substantially coincident with edge 58 of main floor section 34. A second pair of support beams 47 and 49 are coupled with extendable roof sections 46 and 48 respectively to provide support to their respective roof sections 46 and 48. Extendable roof section 46 and support beam 47 are attached to main roof section 44 to allow for pivotal movement of extendable roof section 46 about an axis substantially coincident with edge 62 of main roof section 44. Extendable roof section 48 and support beam 49 are attached to main roof section 44 to allow for pivotal movement of extendable roof section 48 about a pivot axis substantially coincident with edge 64 of main roof section 44.

In the illustrated embodiment, support beams 37, 39, 47 and 49 are structurally identical and only differ in the manner they are attached to their respective components. For illustrative purposes, only support beams 37 and 47 will be discussed in detail. Support beam 37 includes legs 121 and 122. In the illustrated embodiment, leg 121 is shorter than leg 122. By attaching flexible cable 144 to support beam 37 on the first leg, away from its intersection with leg 122, a mechanical advantage is achieved during lifting of extendible floor section 36. Also, this configuration minimizes the length of flexible cable required. The length of leg 122 allows for a more stable attachment of support beam 37 to extendible floor section 36. Similarly, the attachment of cable 140 to leg 123 of support beam 47 provides a mechanical advantage when lifting extendible roof section 46, and minimizes the length of cable 140 required. Also, the length of leg 124 provides a more stable attachment between support beam 47 and extendible roof section 46.

Beams 37, 39, 47 and 49 may be provided in various configurations. For instance, leg 122 of support beam 37 does not need to span the entire length of extendible floor section 36. In another embodiment, leg 122 may only span one-half the length of extendible floor section 36. Furthermore, support beams 37, 39, 47 and 49 are not specifically required within the teachings of the present invention. In another embodiment, flexible cables 140 and 144 may be directly coupled to extendible roof sections 46 and 48 and extendible floor sections 36 and 38.

Although the support beams of the illustrated embodiment are generally triangular shaped, many other sizes and configurations are available for use within the teachings of the present invention. For example, any standard roof, floor or wall support, including rectangular beams, may be utilized interchangeably with support beams 37, 39, 47 and 49.

Roof panel 72 of garage assembly 70 is preferably attached to extendable roof section 46 at an outer edge 82 of extendable roof section 46 by one or more hinge assemblies (not expressly shown). This attachment allows for pivotal movement of roof panel 72 about an axis substantially coincident with outer edge 82 of extendable roof section 46. The connection between sidewall 74 and roof panel 72 of garage assembly 70 allows pivotal movement of sidewall 74 about a pivot axis substantially coincident with outer edge 86 of roof panel 72. Roof panel 78 of garage assembly 76 attaches to extendable roof panel 48 at its outer edge 86 to allow for pivotal movement of roof panel 78 about an axis substantially coincident with edge 86. Sidewall 80 of garage assembly 76 is preferably attached to roof panel 78 at its outer edge 88 to allow for pivotal movement of sidewall 80 about an axis substantially coincident with outer edge 88.

Support column 100 is preferably provided at the intersection of main floor section 34, extendable floor section 36 and end wall assembly 60. Support column 100 extends vertically between main floor section 34 and main roof section 44 and joins main roof section 44 at the intersection of main roof section 44, extendable roof section 46 and end wall assembly 60. Another support column 102 couples main floor section 34 and main roof section 44. Support column 102 extends vertically from a point at the intersection of main floor section 34, extendable floor section 38, and end wall assembly 60 and joins main roof panel 44 at its intersection with extendable roof panel 48 and end wall assembly 60. Another pair of support columns (not expressly shown) are provided along end wall assembly 68, providing further support for main roof section 44 with respect to main floor section 34. These support columns, along with support columns 100 and 102, cooperate with main roof section 44, main floor section 34 and end wall assemblies 60 and 68 to further define a storage area 40. As illustrated in FIG. 2D, all of the foldable or extendable components of roof, floor and wall assemblies may be configured to fit within storage area 40. This facilitates simplified storage and transportation of building 30, when not in use.

A ceiling panel 108 may be provided between end wall assemblies 60 and 68, and between support posts 100 and 102. Ceiling panel 108 cooperates with main roof section 44 and support columns 100 and 102 to define a ceiling plenum 110. Ceiling panel 108 is an optional component of building 30 and provides an area to install optional mechanical, electrical or piping components (not expressly shown). Ceiling panel 108 covers and protects these components from below.

Sidewall assembly 50 may be coupled to extendable floor section 36 allowing pivotal movement about an axis substantially coincident with an outer edge 116 of extendable floor section 36. A flexible cable 112 couples sidewall assembly 50 with extendable roof section 46. Flexible cable 112 attaches to extendable roof section 46 at outer edge 82, and attaches to sidewall assembly 50 at a location between outer edge 82 and outer edge 116, when building 30 is in its extended position. Flexible cable 112 provides support to sidewall assembly 50 and insures that sidewall assembly 50 is maintained in a proper position with respect to extendable roof section 46, in the extended position. The flexible cables of the present invention may be provided of nylon, steel, braided lines, chains, rope, wire or polymeric material, within the teachings of the present invention.

Sidewall assembly 52 may be coupled to extendable roof section 48 to allow for pivotal movement of sidewall assembly 52 with respect to extendable roof section 48 about an axis substantially coincident with outer edge 86. Another flexible cable 114 couples sidewall assembly 52 and extendable floor section 38. Flexible cable 114 attaches to extendable floor section 38 at an outer edge 118, and attaches to sidewall assembly 52 at a location between outer edge 114 and outer edge 86 when building 31 is in its extended position. Flexible cable 114 provides support so sidewall assembly 52 and ensures that sidewall assembly 52 is maintained in a proper position with respect to extendible floor section 38, when building 30 is in its extended position.

Many roof, floor and wall sections are attached to one another in a "hinged" fashion, to allow rotation with respect to one another. Various types of hinges and rotatable brackets may be used to attach these sections.

In order to move building 30 from its extended to its stowed position, extendable floor sections 36 and 38 are preferably folded inwardly with respect to main floor section 34. In their stowed position, extendable floor sections 36 and 38 extend from main floor section 34 toward main roof section 44, and are generally enclosed within storage 40. Sidewall assembly 52 may fold or pivot with respect to outer edge 86 extendable roof panel section 48 until sidewall assembly 52 abuts extendable roof section 48. As extendable roof section 48 pivots downward with respect to edge 64 of main roof section 44, roof panel 78 of garage assembly 76 folds or pivots upwardly with respect to outer edge 86 until it abuts extendable roof section 48. Sidewall 80 of garage assembly 76 folds or pivots downwardly with respect to outer edge 88 until sidewall 80 abuts roof panel 78.

Roof section 46 may be folded or pivoted with respect to edge 62 until roof section 46 extends downward from edge 62 of main roof section 44, toward edge 56 of main floor section 34. At this point, roof section 46 is enclosed within storage area 40. This forces sidewall assembly 50 to fold and pivot at outer edge 116 of floor section 36 until sidewall assembly 50 abuts floor section 36 in a substantially horizontal position. Roof panel 72 folds or pivots with respect to edge 82 of roof section 46 and extends upwardly until roof panel 72 abuts extendable roof section 46. Sidewall 74 pivots with respect to outer edge 86 until sidewall 74 abuts roof panel 72 of garage assembly 70. At this point, garage assembly 76 and roof section 46 may be forced into storage area 40. Sidewall assembly 50 and floor section 36 may then fold or pivot with respect to edge 56 of main floor section 34 until floor section 36 and sidewall assembly 50 extend generally vertically from edge 56 of main floor section 34 toward edge 62 of main roof section 44. As illustrated in FIG. 2D, all of the extendable floors, roofs, walls, and panels can be enclosed entirely within storage area 40.

Figure 3:
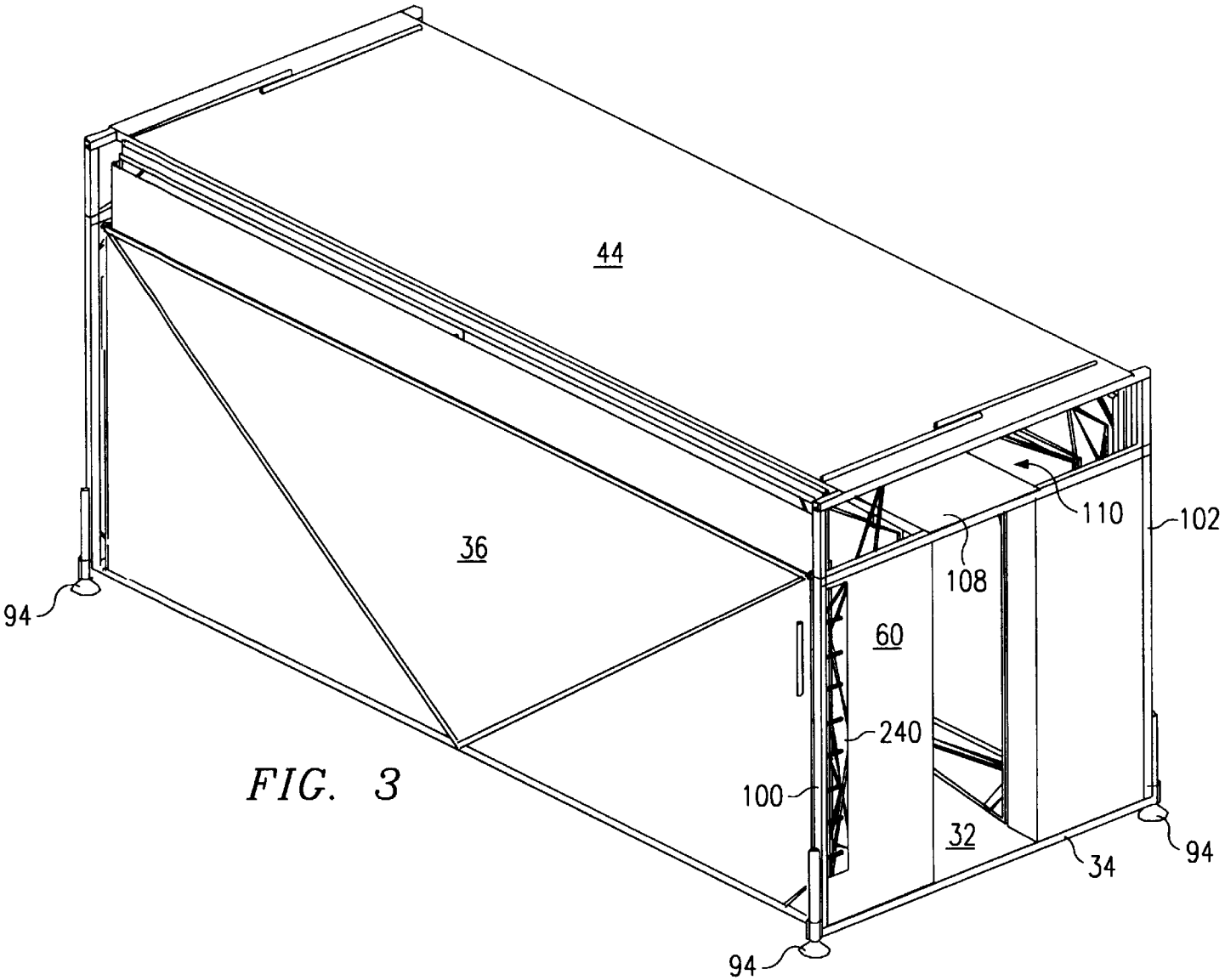
FIG. 3 is a schematic drawing showing a perspective view of the extendable and retractable building of FIG. 1, in its stowed position.

FIG. 3 illustrates building 30 in its stowed position, ideal for storage and transportation of building 30. In one embodiment, in its stowed position, building 30 may have a height of approximately eight and one-half feet, an overall width of approximately eight feet, and an overall length of nineteen and one-half feet. A ladder 240, provides convenient access to roof section 42 and the upper portion of building 30. The dimensions of building 30 in its stowed position will vary greatly depending upon the number of components associated with the roof, floor, walls, and their respective configuration. In its stowed position, building 30 is an ISO container compliant with international shipping standards.

Figure 4:
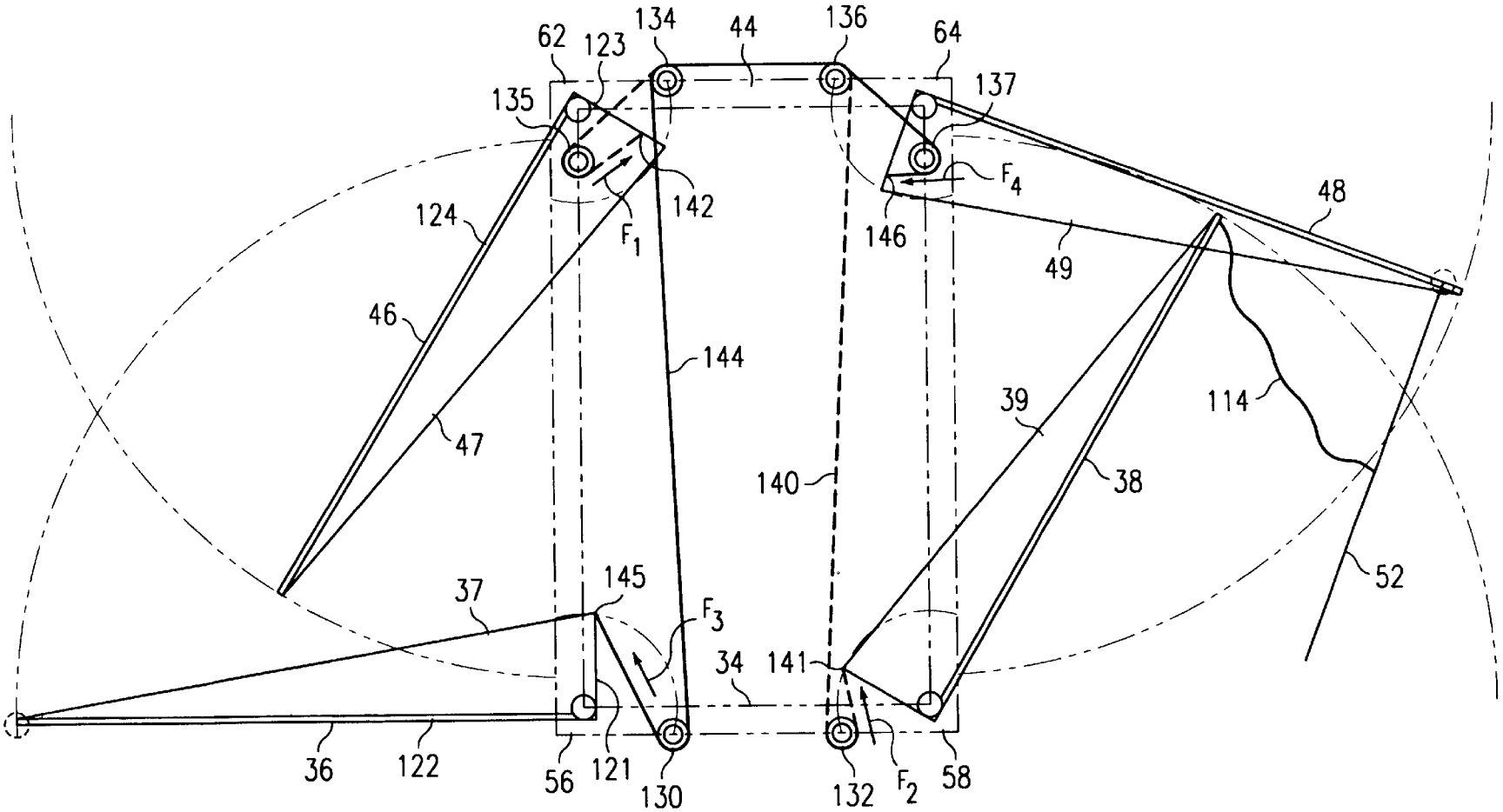
FIG. 4 is a schematic drawing in section of the extendable and retractable building of FIG. 1, with portions broken away, showing selected components thereof.

One aspect of the present invention involves the ease of use, and minimal effort required to expand and/or retract building 30 from its extended and stowed positions. FIG. 4 illustrates a portion of building 30 with a number of components incorporated to simplify its use. Two pulleys 130 and 132 are installed along main floor section 34. Two more pulleys 134 and 136 are installed along main roof section 44. First end 141 of flexible cable 140 is coupled to support beam 39. Second end 142 of flexible cable 140 is coupled to support beam 47 of extendable roof section 46. From first end 141, flexible cable 140 loops partially around and underneath pulley 132, extends vertically upward partially around and above pulley 136, extends horizontally partially around and above pulley 134, extends around pulley 135 which is coupled to support beam 47, and finally connects to support beam 47 at second end 142.

Pulley 137 is coupled to support beam 49 of extendable roof section 48. First end 145 of flexible cable 144 is coupled to support beam 37 of extendable floor section 36. Second end 146 of flexible cable 144 is coupled to support beam 49 of extendable roof section 48. Beginning at first end 145, flexible cable 144 is coupled to support beam 37, extends partially around and beneath pulley 130, extends vertically upwardly, partially around and above pulley 134, extends horizontally partially around and above pulley 136, loops around pulley 137 and attaches to support beam 39 at its second end 146.

Flexible cables 140 and 144 are preferably sized to remain in tension at all times without regard to the position of respective extendable floor and roof panels. Gravity exerts a force on extendable roof section 46 which is proportional to the weight of roof section 46. Since extendable roof section 46 is hinged at edge 62, the force of gravity downward will urge extendable roof section 46 to rotate downwardly toward its stowed position. This produces a force $F_1$ in flexible cable 140 which tends to pull flexible cable 140 from pulley 135, toward second end 142, thereby increasing the tension in flexible cable 140. Gravity also exerts a force upon extendable floor section 38 in proportion to the weight of extendable floor section 38 in a direction vertically downward. This urges extendable floor section 38 to rotate downwardly about its pivot point at edge 58. The weight of extendable floor section 38, therefore, transfers a force $F_2$ to flexible cable 140 in a direction from pulley 132 toward first end 141, further increasing the tension within flexible cable 140. Forces $F_1$ and $F_2$ are transferred throughout flexible cable 140 in opposing directions, and tend to "balance," equalize, or cancel each other out. This significantly reduces the amount of force required to extend or retract extendable floor section 38 and extendable roof section 46.

The force of gravity on extendable floor section 36 is generally proportional to its weight and urges extendable floor section 36 to rotate downward about an axis coincident with edge 56. This transfers a force $F_3$ to extendable cable 144 urging cable 144 in a direction from pulley 130 toward first end 145, thereby increasing the tension within flexible cable 144. The weight of extendable roof section 48 forces roof section 48 downward rotating about edge 64. This transfers force $F_4$ to flexible cable 144 urging flexible cable 144 in a direction from pulley 137 toward second end 146, further increasing the tension of flexible cable 144. Accordingly, forces $F_3$ and $F_4$ tend to "balance," equalize, or cancel each other out. This significantly reduces the amount of force required to extend or retract extendable floor section 36 and extendable roof section 48.

The amount of force necessary to expand building 30 from its stowed position to its extended position is minimized by incorporating flexible cables 140 and 144 and pulleys 130, 132, 134, 135, 136, and 137. The expandability of building 30 is enhanced by counter-balancing the weight of extendable roof sections or panels and extendable floor sections or panels. More specifically, the weight of extendable roof section 48 as it is moved from its extended to its stowed position contributes to the force required to move extendable floor section 36 from the extended to the stowed position. Similarly, the weight of extendable roof section 46, as it is moved from its extended to its stowed position, is transferred through flexible cable 140 and contributes to the force required to lift extendable floor section 38. Accordingly, each extendable roof and floor section may be rotated between extended and stowed positions using a minimal amount of force.

Forces $F_1$ and $F_2$, which are transferred to flexible cable 140, due to the weights of extendable roof section 46 and extendable floor section 38, respectively, are not perfectly balanced during their movement from the extended to the stowed position. For example, as extendable floor section 38 and extendable roof section 46 are moved from their fully extended positions, to positions half way between fully extended and stowed, or their respective "half-extended" positions, no external force must be introduced. As extendable roof section 46 moves from its extended to its half-extended position, the weight of sidewall assembly 50 transfers a force to flexible cable 112, since sidewall assembly 50 moves from its extended toward its stowed position. Accordingly, during this movement, $F_2$ will be greater than $F_1$, and extendable roof section 46 and extendable floor section 38 will naturally tend toward their half-extended positions. As extendable roof section 46 and extendable floor section 38 move from their half-extended positions to their stowed positions, external forces must be introduced.

This is due to the force exerted on extendable floor section 38 from flexible cable 114, due to the weight of sidewall assembly 52, as it is raised from its extended to its stowed position.

In another embodiment, floor section 38 may be coupled with roof section 46 through a series of pulleys and a flexible cable, in order to balance each other during extension or retraction of building 30. Many other arrangements for balancing the weight of various sections are available for use within the teachings of the present invention.

Similarly, as extendable roof section 46 and extendable floor section 38 move from their stowed position to their half-extended positions, no external forces must be applied. However, as extendable roof section 46 and extendable floor section 38 move from their half extended positions to their fully extended positions, external forces are required.

In order to correct for variations in the weights of associated roof and floor components, and variable forces exerted upon each during extending and retracting of building 30, spiral springs may be incorporated at all driven spools, as required. Accordingly, the neutral point of spring tension will occur at one half of the total required rotation. At this point, the rotation of the spiral spring changes its direction of force.

In one embodiment, the external force required to expand and retract building 30 between its extended and retracted positions may be introduced manually, or by hand. This can be accomplished by placing optional handles (not expressly shown) at appropriate positions upon building 30. Building 30, may then be forced between its extended and stowed positions manually by an installer. Alternatively, a system of levers (not expressly shown) may be incorporated into building 30, and/or the required forces may be introduced by attaching cables to ground vehicles, suitable movement in the appropriate direction to expand or retract building 30.

Figure 5A:
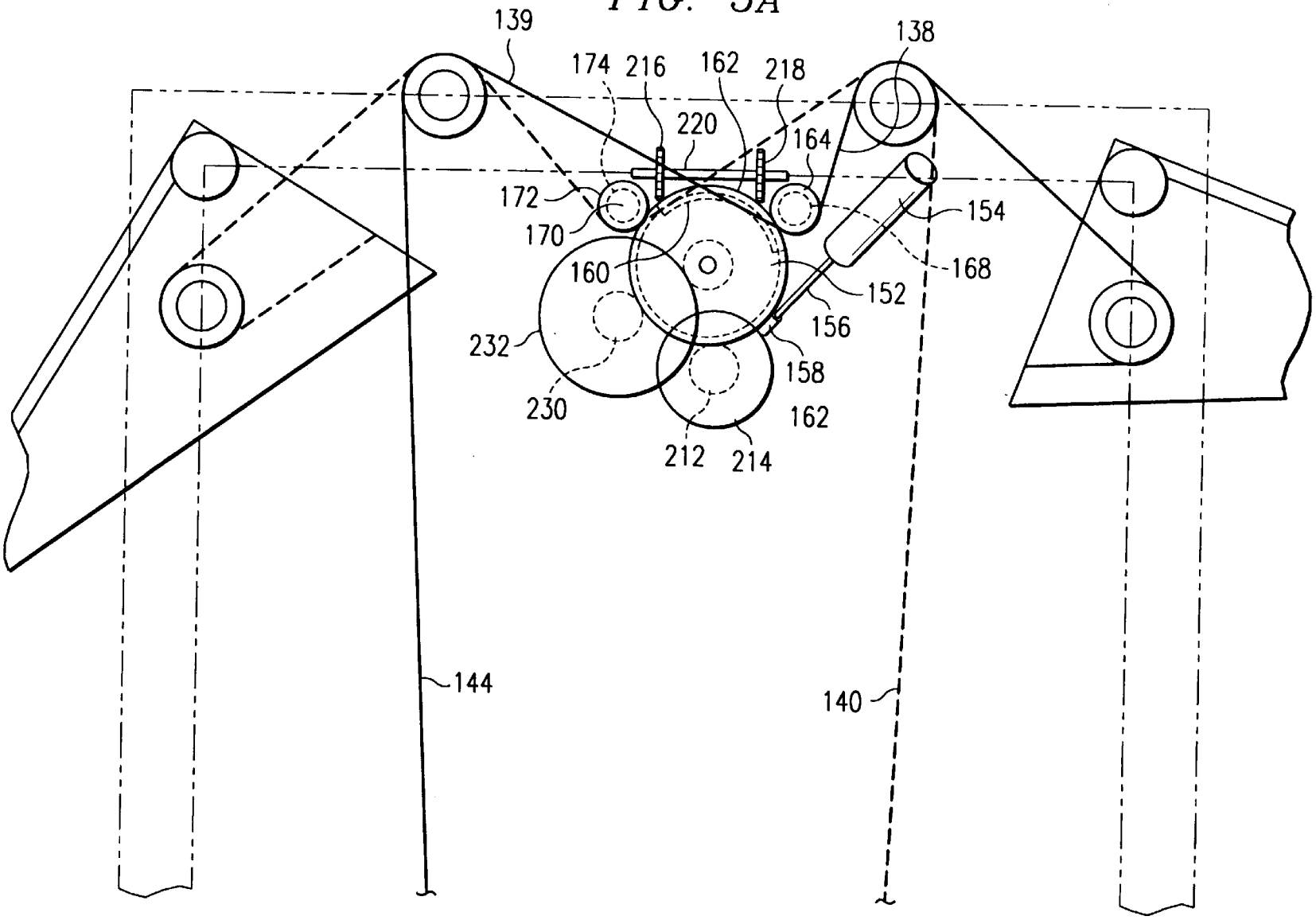
FIGS. 5A–5C schematic drawings in section, with portions broken away, of an extendable and retractable building, showing different configurations of selected components.
Figure 5B:
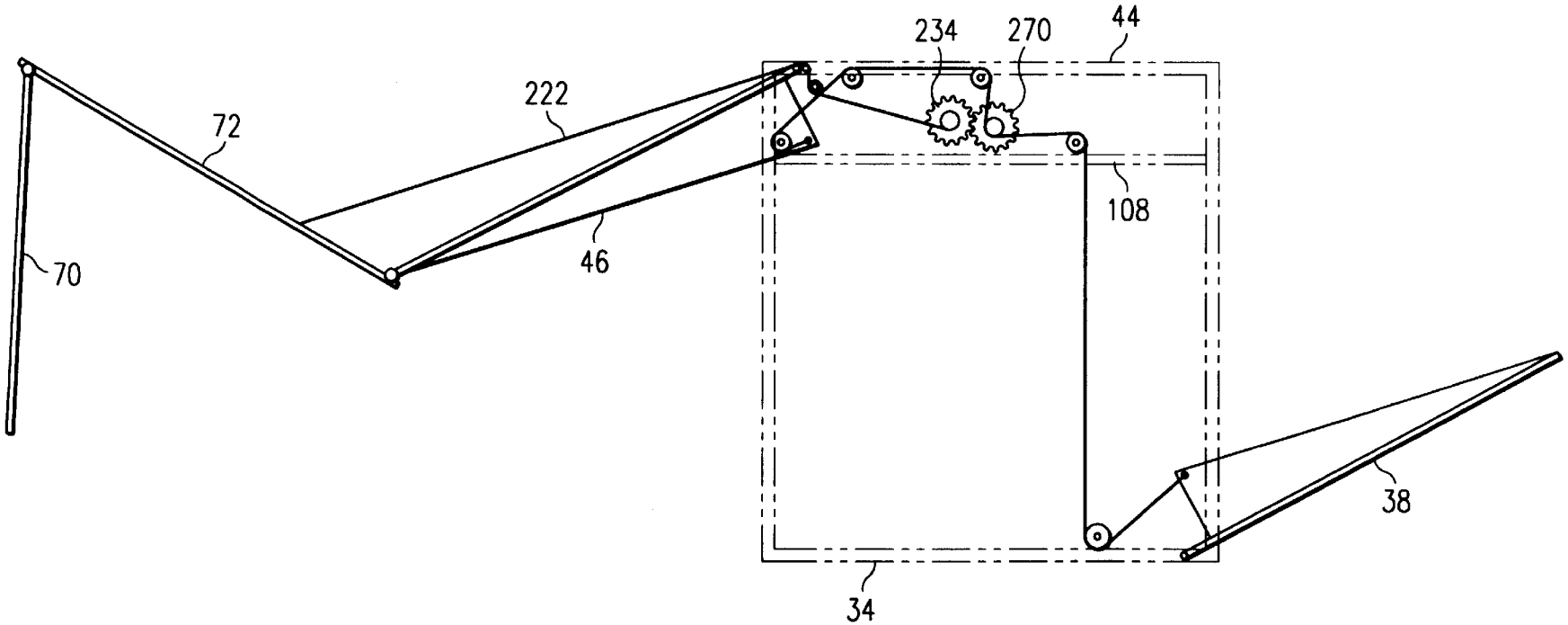

As illustrated in FIGS. 5A and 5B, in another embodiment, one or more gear assembles may be installed upon building 30 in order to move building 30 between its extended and stowed positions. In the illustrated embodiment a main gear 152 is installed on main roof section 44. Main gear 152 is driven by a motor 154, drive train 156, and worm gear assembly 158. Motor 154 and drive train 156 are preferably provided with a nonslip transmission (not expressly shown) such that extending or retracting building 30 will cease upon a pre-determined force opposing such movement. This feature will prevent damage or injury to building 30 caused by obstructions to its proper function.

It will be obvious to those skilled in the art that main gear assembly 152 may be driven by alternative means, including a drive shaft attached to main gear 152. A plurality of gear teeth 160 are disposed upon a portion of the outer perimeter 162 of main gear 152. Gear teeth 160 drive various other optional gears to extend and retract various roof sections, floor sections, sidewalls, and garage units.

A secondary gear 164 is installed upon main gear 152 with a plurality of teeth 166 sized to cooperate with gear teeth 160 and operable to rotate secondary gear 164 in response to rotation of main gear 152. Secondary gear 164 will only turn when gear teeth 160 are adjacent to secondary gear 164. Once the portion of perimeter 162 possessing gear teeth 160 has completely bypassed secondary gear 164, rotation of secondary gear 164 will cease. A spool 168 is coupled to secondary gear 164 with flexible cable 140 disposed therearound. Rotation of secondary gear 164 in a first direction, clockwise as illustrated in FIG. 5A, will collect flexible cable 140 at its first leg 138 and release flexible cable 140 at its second leg 139; this forces extendable roof section 46 and extendable floor section 38 from their respective extended positions to their respective stowed positions. Rotation of secondary gear 164 in an opposite direction, or counterclockwise in FIG. 5A, will force extendable roof section 46 and extendable floor section 38 from their respective stowed positions to their respective extended positions.

Another secondary gear 170 may be rotatably connected to the perimeter of main gear 152. Secondary gear 170 has a plurality of teeth 172 sized to cooperate with gear teeth 160 of main gear 152, and operable to rotate secondary gear 170 in response to rotation of main gear 152. Secondary gear 170 will only rotate when gear teeth 160 are adjacent to secondary gear 170, during the rotation of main gear 152. A spool 174 is coupled with secondary gear 170 and flexible cable 144 is disposed therearound. Secondary gear 170 cooperates with flexible cable 144 in a similar manner to the operation of secondary gear 164 with respect to flexible cable 140. Accordingly, rotation of secondary gear 170 in a first direction, clockwise as shown in FIG. 5A will force extendable roof section 48 and extendable floor section 36 from their respective extended positions to their respective stowed positions. Conversely, rotation of secondary gear 170 in an opposite direction, or counterclockwise as shown in FIG. 5A, will force extendable roof section 48 and extendable floor section 36 from their stowed, to their extended positions.

As illustrated in FIGS. 6A and 6B, end wall assembly 60 comprises a first stationary, or main end wall section 180 and two extendable end wall sections 182 and 184. End wall assembly 68 comprises a first stationary or main end wall section 186, and a pair of extendable end wall sections 188 and 190. Extendable end wall section 182 is attached by one or more hinge assemblies (not expressly shown) to main end wall section 180. This attachment allows pivotal movement of extendable end wall section 182 about an axis substantially coincident with edge 179 of main end wall section 180. Extendable end wall section 184 is attached to main end wall section 180 and allows for pivotal movement of extendable end wall section 184 about an axis substantially coincident with outer edge 181 of main end wall section 180. Similarly, extendable end wall sections 188 and 190 are attached to main end wall section 186 to allow for pivotal movement about edges 185 and 187 of main end wall section 186, respectively.

In their respective stowed positions, extendable end wall sections 182 and 184 extend from main end wall section 180 toward main end wall section 186, substantially perpendicular to main end wall section 180, and are enclosed within storage area 40. In their respective stowed positions, extendable end wall sections 188 and 190 extend from main end wall section 186 toward main end wall section 180, substantially perpendicular to main end wall section 186, and are enclosed within storage area 40. In their extended positions, extendable end wall sections 182 and 184 extend outwardly from, and are generally coplanar with main end wall section 180, and extendable end wall sections 188 and 190 extend from, and are generally coplanar with, main end wall section 186.

Extendable end wall sections 182, 184, 188 and 190 may be forced between their extended positions and stowed positions manually, or a mechanical system may be installed to assist in this process. A pulley assembly 200 comprising two pulleys 202 and 204 is installed upon building 30. A flexible cable 206 is installed around pulleys 202 and 204, allowing rotation of flexible cable 206 with respect to pulleys 202 and 204. A pair of scissors levers 208 and 210 are fixedly coupled with flexible cable 206. Rotation of flexible cable 206 with respect to pulleys 202 and 204 translates into movement of scissors levers 208 and 210 substantially perpendicular to an axis 212 through pulleys 202 and 204. As flexible cable 206 is rotated in a direction clockwise as illustrated in FIG. 6A, scissors levers 208 and 210 move away from main end wall sections 180 and 186, respectively, and toward one another. Conversely, rotation of flexible cable 206 in a counterclockwise direction, as illustrated in FIG. 6A, forces scissors levers 208 and 210 away from each other, and toward main end wall sections 180 and 186 respectively. Scissors lever 208 is coupled with extendable end wall sections 182 and 184 near edges 179 and 181, respectively, of main end wall section 180.

As scissors lever 208 moves along axis 212 away from main end wall section 180, extendable end wall sections 182 and 184 are forced from their extended to their stowed positions. Movement of scissors lever 208 along axis 212, toward main end wall section 180, forces extendable end wall sections 182 and 184 from their stowed to their extended positions.

Scissors lever 210 is coupled with extendable end wall sections 188 and 190 at edges 185 and 187, respectively, of main end wall section 186. Similar to the operation of scissors lever 208, movement of scissors lever 210 along axis 212 away from main end wall section 186 will force extendable end wall sections 188 and 190 from their extended to their stowed positions. Counterclockwise rotation of flexible cable 206 will force scissors lever 210 along axis 212, toward main end wall section 186, and end wall sections 188 and 190 are forced from their stowed to their extended positions.

As illustrated in FIG. 6B, extendable end wall sections 284 and 290 may be provided to extend in an accordion like fashion to provide a larger overall building. In this embodiment, a side support wall 250, may also be incorporated into the extendable and retractable building.

In order to simplify, or automate the movement of extendable end wall sections 182, 184, 188 and 190 movement between their extended and stowed positions, a secondary gear 212 may be rotatably coupled with main gear 152 of FIG. 5A. Secondary gear 212 has a plurality of teeth (not expressly shown) at its perimeter which cooperate with gear teeth 160 to force rotation of secondary gear 212 in response to rotation of main gear 152. Secondary gear 212 will only rotate when gear teeth 160 are adjacent to secondary gear teeth 212. Spool 214 is coupled with secondary gear 212. A flexible cable (not expressly shown) couples spool 214 with spools 216 and 218 which are connected by an axle 220 disposed therebetween. Rotation of main gear 152 may then translate into rotation of main gear 212 and spool 214 which in turn, rotate spools 216 and 218. Rotation of spools 216 and 218 in opposing directions, will cause rotation of flexible cable 206 in respective opposing directions, moving extendable end wall sections 182, 184, 188 and 190 between their stowed and extended positions.

Additional gear and spool assemblies may be provided, as required to operate various other components of building 30. Gear 230 and pulley 232 of FIG. 5A may be coupled with cable(s) attached to such components.

Figure 5C:
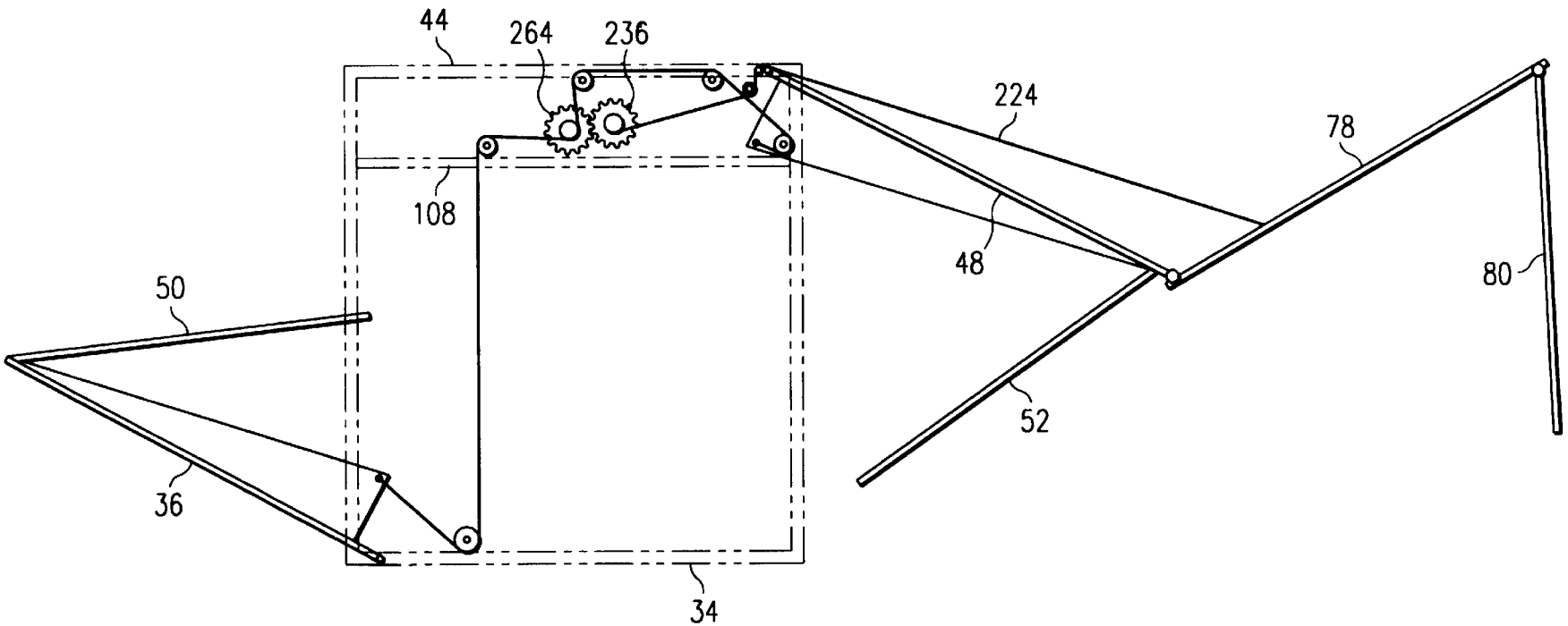

The configuration of pulleys, spools and gears illustrated in FIG. 5A is for illustration only. Gear and spool assemblies similar to those of FIG. 5A may be provided at each end of building 30, in proximity to the extendable end wall sections. In fact, it will be recognized by those of ordinary skill in the art that the number, size, and configuration of pulleys, spools, gears, and other mechanical components may vary greatly within the teachings of the present invention. For example, FIGS. 5B and 5C illustrate alternative embodiments of gear and pulley assemblies suitable to extend and retract building 30.

Furthermore, additional components are available for causing rotation of main gear 152. For instance, a transmission can be operated by an electric hand-held power drill, in lieu of motor 14. In this embodiment, it may be desirable to situate a shaft coupled to main gear 152, so that it is accessible from the exterior of building 30. This shaft could also be operated by a hand crank or other mechanical device capable of causing rotation of the drive shaft.

In the illustrated embodiment building 30 is designed to be carried on a trailer or truck. Once the destination has been reached, the system may be uplifted from the trailer using floor jacks 94 (see FIG. 8). Various types of mechanical, pneumatic and/or hydraulic jacks may be satisfactorily used with the present invention. When building 30 has been raised to a sufficient clearance above the trailer, the trailer can be driven out from underneath building 30. At that point, floor jacks 94 may be used to set building 30 at the desired elevation. This is typically between 10 and 20 inches above ground level, dependent upon the specific application. Floor jacks 94 are also used to align and level building 30 to correct any imperfections in the ground surface.

Building 30 may weigh greater than three tons. Each floor jack 94 should be rated to individually carry the entire weight of building 30. Floor jacks 94 may be removable from or integral with building 30. Once building 30 is leveled in place, building 30 is ready to be unfolded, or extended.

Motor 154 may then be activated in order to begin the rotation of main gear 152. Since the configuration of building 30 minimizes the amount of external force required, two average automobile engine starter-motors and the DC electricity of an average automobile generator are sufficient to extend, and/or retract building 30. Motor 154 causes rotation of drive shaft 156 which in turn, drives worm gear assembly 158. This translates into rotation of main gear 152.

Initially, main gear 152 engages secondary gear 170 thereby moving extendable roof section 46 and extendable floor section 38 from their stowed to their extended positions. Extendable floor section 38 will open downwardly due to the force of gravity, slowed by the tension of flexible cable 140, due in part to the weight of extendable roof section 48. Simultaneously, extendable roof section 46 will be upraised due in part to the tension within flexible cable 140. Roof panel 72 and sidewall 74 are urged to their respective extended positions in part by gravity, and also by flexible cable 222 (FIG. 5B) as it is collected by another gear and spool assembly 234 rotationally synchronized with secondary gear 270. Gear assembly 270 of FIG. 5B accomplishes a similar function to gear 170 and pulley 172 of FIG. 5A.

Gear teeth 160 next encounter teeth 166 of secondary gear 164, causing the rotation of spool 168. As previously described, this causes movement of extendable roof section 48 and extendable floor section 36 from their stowed, to their extended positions. During this process, roof panel 78 and sidewall 80 are urged toward their extended positions in part by gravity, and in part by flexible cable 224 as it is collected along gear and spool assembly 236 (FIG. 5C) rotationally synchronized with gear 264. Gear and spool assembly 236 of FIG. 5C accomplishes a similar function to gear 164 and spool 168 of FIG. 5A. Extendable floor section 36 is partially urged toward its extended position by gravity, resisted by flexible cable 144. This force is transferred through flexible cable 144 and helps urge extendable roof section 48 to its extended position. Lock joints (not expressly shown) incorporated into each floor, roof and garage component may then be actuated to secure building 30 in its extended position.

In their extended positions, extendable roof sections 46 and 48 are not coplanar with main roof section 44. The final position in their extended position dips 10 degrees downward with respect to the plane of main roof section 44. This declination is desirable to facilitate the installation of their respective pulleys 134, 135, 136 and 137. Building 30 may then be leveled using adjustable support posts 90 and 92, and floor jacks 94.

Next, gear teeth 160 contact and cause rotation of gear 212. This movement causes the rotation of spools 216 and 218 which urges flexible cable 206 to rotate simultaneously. Extendable end wall sections 182, 184, 188 and 190 are then forced from their stowed to their extended positions due to the movement of scissors levers 208 and 210. Extendable end wall sections may then be locked in place by lock joints incorporated into their respective connection assemblies.

Building 30 is now in its fully extended position, and ready for use. Furnishings may be introduced including collapsible furniture and closets incorporated within. Mechanical, electrical and plumbing connections may also be accomplished, as desired.

In another embodiment, as illustrated in FIG. 7, garage assemblies 70 and 76 may be raised manually to form a canopy type roof. For some applications, this may provide enhanced protection from the environment. Furthermore, this configuration of building 30 provides additional living and/or storage space, as required. Structural components may be incorporated into the components of garage assemblies 70 and 76 as required, to secure them in place.

The basic structural components of building 30, defined in part by main roof section 44, ceiling panel 108, main floor section 34, support columns 100 and 102, and main end wall sections 180 and 186 may be constructed using two-millimeter thick square piping 50 millimeter×50 millimeter. In the illustrated embodiment, roof, floor and wall sections comprise flat rectangular pieces. Roof, floor and wall sections may be provided in a variety of sizes, shapes, and material, within the teachings of the present invention.

Extendable roof, floor and end wall sections are secured by hinges. Support columns 100 and 102 and other structural support members associated with main end wall sections 180 and 186 are situated slightly within storage area 40, to ensure that once the system is folded, extendable roof, floor, garage and end wall sections will be fitted inside the basic structure defined in part by storage area 40. Fixed connections associated with building 30 may be welded, or mechanical connections may be made. Extendable floor and roof sections may be constructed of two-millimeter thick 25 millimeter diameter piping. Roof, floor, and wall sections may be linked to each other through basic structural pins or knuckles of fifteen-millimeter diameter. Flexible rubber seals (not expressly shown) may be fixed together with the basic structural components of building 30 to form a fluid proof seal. Structural piping associated with building 30 may be provided of stainless steel, to provide a more durable application. Rubber matting may also be provided on all exposed roof components to prevent leakage.

In another embodiment, extendable floor sections 36 and 38 may be lowered to contact the ground at their respective outer edges 114 and 116. This facilitates wheelchair and forklift access, as required. In order to accomplish this, support posts 37 and 39 can be configured at angles greater than 90 degrees such that they extend downwardly with respect to ground level.

It will be recognized by those skilled in the art that building 30 may incorporate various configurations of extendable roof, floor, wall and garage sections. The extension of each section may be accommodated by various number, size and configurations of gears, spools and pulleys, in addition to those described herein. Roof and floor extension panels that slide out from extendable roof sections and/or extendable floor sections, or pivot from the ends of same, may also be incorporated.

Additional driven gears, spools, pulleys, and drive trains may also be configured and optionally coupled with main gear 152 to accomplish opening and closing sequences.

In another embodiment, the main gear can be replaced by a rack gear, along with driven gears arranged to rotate in sequence. The rack gear may be powered by a hydraulic or pneumatic piston/cylinder. Various hand and/or foot operated mechanisms are also possible for driving the main gear, or rack gear, alone or in combination.

Although the present invention has been described by several embodiments, various changes and modifications may be suggested to one skilled in the art. It is intended that the present invention encompasses such changes and modifications as fall within the scope of the present appended claims.

What is claimed is:

1. An extendable and retractable building comprising:

a floor assembly having a plurality of first components which may be moved between respective stowed positions and extended positions;

a roof assembly having a plurality of second components which may be moved between respective stowed positions and extended positions;

a support structure coupling the floor assembly and the roof assembly;

a first cable coupled to one of the first components and one of the second components; and the first cable extending through at least two pulleys, the first cable having a first force and a second force distributed in opposing directions, the first and second forces approximately equal to at least partially balance the weight of the floor assembly and the roof assembly when moving between their respective stowed and extended positions.

2. The extendable and retractable building of claim 1, wherein the first cable and at the least two pulleys are located at a first end of the building, and further comprising a second cable extending through at least two additional pulleys, the second cable and the at least two additional pulleys located at a second end of the building, opposite the first end.

3. The extendable and retractable building of claim 1, further comprising:

the first components associated with the floor assembly including a first floor section with second and third floor sections attached to the first floor section and independently movable between the respective stowed and extended positions;

the second components associated with the roof assembly including a first roof section with second and third roof sections attached to the first roof section and independently movable between the respective stowed and extended positions;

the first cable coupled with a first support beam connected with the second floor section and a second support beam connected with the third roof section; and a second cable coupled with a third support beam connected with the third floor section and a fourth support beam connected with the second roof section.

4. The extendable and retractable building of claim 3, wherein the first, second, third and fourth support beams further comprises at least one leg, the first cable coupled to the first and second support beam legs and the second cable is coupled to the third and fourth support beam legs.

5. The extendable and retractable building of claim 3, wherein:

the first floor section and the first roof section are disposed generally parallel with and vertically spaced from each other;

the second and third floor sections extend from the first floor section toward the first roof section and at least partially occupy a space between the first floor section and first roof section when the second and third floor sections are disposed in their respective stowed positions; and the second and third roof sections extend from the first roof section toward the first floor section and at least partially occupy a space between the first floor section and the first roof section when the second and third roof sections are disposed in their respective stowed positions.

6. The extendable and retractable building of claim 3, wherein:

the second and third floor sections extend outwardly from the first floor section when the second and third floor sections are disposed in their respective extended positions; and the second and third roof sections extend outwardly from the first roof section when the second and third roof sections are disposed in their respective extended positions.

7. The extendable and retractable building of claim 3, further comprising:

a first gear assembly sized to engage a portion of the first cable whereby rotation of the first gear assembly in a first direction moves the second floor section and the third roof section from their respective stowed positions to their respective extended positions, and rotation of the first gear assembly in a second direction, opposite the first direction, moves the second floor section and the third roof section from their respective extended positions to their respective stowed positions; and a second gear assembly sized to engage a portion of the second cable whereby rotation of the second gear assembly in a first direction moves the third floor section and the second roof section from their respective stowed positions to their respective extended positions, and rotation of the second gear assembly in a second direction, opposite the first direction, moves the third floor section and the second roof section toward their respective extended positions to their respective stowed positions.

8. The extendable and retractable building of claim 7, wherein the first and second gear assemblies further comprise a common main gear and a common drive shaft assembly.

9. The extendable and retractable building of claim 7, wherein at least one spiral spring is coupled with at least one of the first or second gear assemblies to substantially equalize any difference in weight between the first components of the floor assembly and the second components of the roof assembly.

10. The extendable and retractable building of claim 3, further comprising:

a plurality of wall assemblies at least partially disposed between the first floor section and the first roof section; and each wall assembly having a plurality of third components which may be moved between respective stowed and extended positions.

11. The extendable and retractable building of claim 10, further comprising:

a pulley assembly having a third cable engaged therewith; and the third cable attached with two of the wall assemblies whereby movement of the third cable in opposing first and second directions moves the attached wall assemblies between their respective stowed and extended positions.

12. The extendable and retractable building of claim 11, wherein the third cable engages at least one scissors lever to cause the movement of the attached wall assemblies.

13. The extendable and retractable building of claim 11, further comprising a gear assembly coupled to the third cable and operable to move the third cable in the opposing first and second directions.

14. The extendable and retractable building of claim 3, further comprising:

a first sidewall coupled with the second floor section and movable between a stowed position and an extended position; and a second sidewall coupled with the third roof section and movable between a stowed position and an extended position.

15. The extendable and retractable building of claim 14, further comprising:

a third cable coupled to the first sidewall and the second roof section and operable to move the first sidewall to its extended position as the second roof section moves to its extended position; and a fourth cable coupled to the second sidewall and the third roof section and operable to move the second sidewall to its extended position as the third roof section moves to its extended position.

16. The extendable and retractable building of claim 3, further comprising an extendable roof canopy vertically spaced from and at least partially covering the roof assembly.

17. The extendable and retractable building of claim 1, further comprising at least one garage unit coupled to the roof assembly and movable between a stowed position and an extended position whereby the garage unit extends outwardly from the roof assembly at least partially enclosing a garage area.

18. The extendable and retractable building of claim 1, further comprising a plurality of floor jacks operable to raise and lower the floor assembly between a first position defined in part by the floor assembly resting upon a vehicle and a second position defined in part by the floor assembly being vertically spaced from the vehicle.

19. An extendable and retractable building comprising:

a first floor section having generally parallel first and second edges;

a first roof section having generally parallel first and second edges;

a support structure coupling the first floor section and first roof section;

a ceiling panel cooperating with the first roof section to form a ceiling plenum therebetween;

a second floor section and a third floor section, each floor section having at least one support beam coupled thereto, and attached respectively to the first and second edges of the first floor section for movement between respective generally vertical stowed positions and respective generally horizontal extended positions;

a second roof section and a third roof section, each roof section having at least one support beam coupled thereto, and attached respectively to the first and second edges of the first roof section for movement between respective generally vertical stowed positions and respective extended positions in which the second and third roof sections extend outwardly and generally slope away from the first roof section;

a first pulley assembly and a second pulley assembly secured within the ceiling plenum;

the first cable extending through the first pulley assembly and coupling the support beams associated with the second floor section and the third roof section;

the second cable extending through the second pulley assembly and coupling the support beams associated with the third floor section and the second roof section; and the first and second cables operable to at least partially balance the weight of the respectively attached second and third floor sections and the respectively attached second and third roof sections to minimize the amount of force required to move the second and third roof sections and the second and third floor sections between their respective stowed and extended positions.

20. The extendable and retractable building of claim 19 further comprising a plurality of spools secured within the ceiling plenum and sized to engage portions of the first and second cables.

21. The extendable and retractable building of claim 20, further comprising a drive shaft and a single drive gear coupled with each spool whereby rotation of the drive shaft rotates each spool.

22. The extendable and retractable building of claim 20, wherein the first cable and the second cable are disposed at respective opposite ends of the building.

23. A method for extending and retracting a building comprising a floor assembly having first, second and third floor sections, a roof assembly having first, second and third roof sections, and a support structure to maintain the floor assembly and the roof assembly spaced from each other, the method comprising:

coupling a first cable which cooperates with a first pulley assembly to the second floor section and the third roof section to at least partially balance forces associated with the weight of the second floor section and the third roof section while extending and retracting the building;

coupling a second cable which cooperates with a second pulley assembly to the third floor section and the second roof section to at least partially balance forces associated with the weight of the third floor section and the second roof section while extending and retracting the building; and moving the first and second cables to move the roof sections and the floor sections between their respective stowed and extended positions.

24. The method of claim 23, further comprising rotating a main gear assembly coupled with the first and second cables to move the second and third floor sections and the second and third roof sections between their respective stowed and extended positions.

25. The method of claim 23, further comprising raising and lowering the floor assembly between a first vertical position and a second horizontal position.

26. An extendable and retractable building comprising:

a floor assembly having first, second and third floor sections, the second and third floor sections independently moveable between respective stowed positions and extended positions;

a roof assembly having first, second and third roof sections, the second and third roof sections independently moveable between respective stowed positions and extended positions;

a support structure coupling the floor assembly and the roof assembly;

a first cable coupled to a first support beam associated with the second floor section and a second support beam associated with the third roof section, the first cable located at a first end of the building; and the first cable extending through at least two pulleys, the first cable having a first force and a second force distributed in opposing directions, the first and second forces approximately equal to at least partially balance the weight of the second floor section and the third roof section when moving between their respective stowed and extended positions.

27. The extendable and retractable building of claim 26, further comprising:

a second cable coupled to a third support beam associated with the third floor section and a fourth support beam associated with the second roof section, the second cable located at a second end of the building opposite the first end; and the second cable extending through at least two additional pulleys, the second cable having a third force and a fourth force distributed in opposing directions, the third and fourth forces approximately equal to at least partially balance the weight of the third floor section and the second roof section when moving between their respective stowed and extended positions.

28. An extendable and retractable building, comprising:

a frame having a first roof section, a first floor section and a support structure coupling the first roof section and the first floor section;

a second roof section rotatably attached to the first roof section on a first side of the frame;

a second floor section rotatably attached to the second floor section on a second side of the frame opposite the first side; and a cable extending through at least two pulleys, the cable attached to the second roof section and the second floor section such that the cable at least partially balances the weight of the second roof section and the second floor section when the second roof section and second floor section move between respective stowed and extended positions and reduces the force required to move the second roof section and the second floor section between their respective stowed and extended positions.

29. An extendable and retractable building, comprising:

a first roof panel;

a first floor panel;

a first sidewall coupling the first roof panel to the first floor panel on a first side of the building;

a second sidewall coupling the first roof panel to the first floor panel on a second side of the building, the second side opposite the first side;

a second roof panel rotatably attached to the first roof panel on the first side of the building, the second roof panel moveable between a stowed position and an extended position;

a second floor panel rotatably attached to the first floor panel on the second side of the building, the second floor panel moveable between a stowed position and an extended position;

a cable having a first end and a second end, the first end attached to a first support beam associated with the second roof panel and the second end attached to a second support beam associated with the second floor panel, the first and second ends attached to the first and second support beams at points such that the cable transfers the weight of the second roof section in the direction of the second roof section when the second roof section is moved from its extended position to its stowed position and contributes to a force required to move the second floor section from its extended position to its stowed position;

a first pulley attached to the first roof panel at a point where the first end of the cable contacts the first roof panel when the second roof panel is in its stowed position;

a second pulley attached to the first floor panel at a point where the second end of the cable contacts the first floor panel when the second floor panel is in its stowed position; and a third pulley attached to the first sidewall at a point where the first end of the cable contacts the first sidewall when the second roof panel is in its extended position, the first cable extending through the first, second and third pulleys.

* * * * *